US007530865B2

(12) United States Patent
Kado et al.

(10) Patent No.: US 7,530,865 B2
(45) **Date of Patent: *May 12, 2009**

(54) CONTROL DEVICE FOR PLURAL PROPULSION UNITS

(75) Inventors: Takuya Kado, Shizuoka-ken (JP); Shu Akuzawa, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/020,499

(22) Filed: Jan. 25, 2008

(65) Prior Publication Data

US 2008/0182464 A1 Jul. 31, 2008

(30) Foreign Application Priority Data

Jan. 25, 2007 (JP) ..... 2007-014632

(51) Int. Cl.
*B63H 21/22* (2006.01)

(52) U.S. Cl. ..... 440/1; 440/86

(58) Field of Classification Search ..... 440/1, 440/84, 86

See application file for complete search history.

(56) References Cited

U.S. PATENT DOCUMENTS 7,153,174 B2 12/2006 Takada et al.

2005/0245145 A1* 11/2005 Takada et al. ..... 440/1

FOREIGN PATENT DOCUMENTS

JP 08-200110 8/1996
JP 2000-313398 11/2000

OTHER PUBLICATIONS

U.S. Appl. No. 11/966,100, filed Dec. 28, 2007, entitled Control System for Propulsion Unit.

U.S. Appl. No. 11/966,984, filed Dec. 28, 2007, entitled Propulsion Unit Control System.

U.S. Appl. No. 11/971,860, filed Jan. 9, 2008, entitled Control Device For Plural Propulsion Units.

* cited by examiner

*Primary Examiner*—Stephen Avila
(74) *Attorney, Agent, or Firm*—Knobbe, Martens, Olson & Bear, LLP

(57) ABSTRACT

A control device for plural propulsion units executes a control for synchronization of the engine rotational speed of a target propulsion unit with the engine rotational speed of a reference propulsion unit when one or more specified conditions are satisfied. Once synchronization control has been established, it is only cancelled if one of the specified conditions becomes no longer satisfied for a first prescribed duration or if another of the specified conditions becomes no longer satisfied for a second prescribed duration.

13 Claims, 10 Drawing Sheets

CONTROL DEVICE FOR PLURAL PROPULSION UNITS

CROSS-REFERENCE TO RELATED APPLICATIONS

The present application is based on and claims priority under 35 U.S.C. §119 to Japanese Patent Application Serial No. 2007-014632, filed on Jan. 25, 2007, the entire contents of which are expressly incorporated by reference herein.

BACKGROUND OF THE INVENTION

1. Field of the Invention

The present invention relates to a control device for propulsion units of a vessel having a plurality of propulsion units arranged side by side, and more particularly to a control device that selectively synchronizes the engine rotational speeds of the propulsion units.

2. Description of the Related Art

There are vessels having, for example, three propulsion units such as outboard motors, stem drives, inboard-outboard motors or the like arranged at the stem. Conventionally, in a vessel of this type, a shift lever and a throttle lever are provided for each one of the propulsion units. However, it can be complicated to operate all of the shift levers and throttle levers (six in total) in addition to a steering wheel.

A recently-developed vessel has operation control units for controlling the operating conditions of respective outboard motors that are connected to each other by communication lines for transferring operating information of respective outboard motors (See Japanese Publication No. JP-A-Hei 8-200110). Also, a vessel has been developed in which the shifts and throttles of a plurality of propulsion units are operable by two control levers laterally disposed adjacent to each other. If a difference occurs between the engine rotational speeds of the engines of the right and left propulsion units when the control levers are tilted at the same angle, based for example on the engine rotational speed of the engine of the right propulsion unit, a motor in a throttle drive part is driven to adjust the throttle and thus eliminate the difference between this engine rotational speed and the engine rotational speed of the left propulsion unit. As such, and the engine rotational speeds of the right and left engines are synchronized (see Japanese Publication No. JP-A-2000-313398).

SUMMARY OF THE INVENTION

Although the engine rotational speeds of the propulsion units are synchronized when the right and left control levers are tilted at the same angle as described above, a priority is decided at the time when the power switches of first and second control units are turned ON so that a first steering mode can be used. Synchronization is achieved by the second control unit in a second steering mode, and the synchronizing control is cancelled when the operation mode is restored to the first steering mode by the first control unit. However, since the control for synchronization of engine rotational speeds and cancel of the control are executed by operating the power switches of the first and second control units, the operation is complicated. There has been no control device which synchronizes the engine rotational speeds of propulsion units and cancel the synchronization taking even the operating environment and operating conditions into account.

The present invention has been made in view of the current situation, and it is, therefore, an object of the present invention to provide a control device for propulsion units capable of achieving a natural and stable control in accordance with the steering intention of the operator by setting a cancel determination condition of a rotation synchronizing control in detail depending on the operating conditions.

In accordance with one embodiment, the present invention provides a propulsion unit control system for a vessel having a plurality of propulsion units arranged side by side and electrically connected in association with two control levers that are controllable by an operator to operate a shift actuator and/or a throttle actuator of a corresponding one of the propulsion units. The control system is configured to synchronize the engine rotational speed of a target one of the propulsion units with the engine rotational speed of a reference one of the propulsion units when a specified condition is satisfied. The control system comprises a first control lever corresponding to the reference propulsion unit, a second control lever corresponding to the target propulsion unit, a lever position detector adapted to detect a lever position of the first and second control levers, and an engine rotational speed detection device configured to detect an engine rotational speed of the reference propulsion unit and an engine rotational speed of the target propulsion unit. The control system is configured so that engine synchronization is cancelled when either a deviation between the first lever position and the second lever position has been equal to or greater than a lever determining value for a first prescribed duration, or when a deviation between the engine rotational speed of the reference propulsion unit and the engine rotational speed of the target propulsion unit has been equal to or greater than an engine speed determining value for a second prescribed duration.

One such embodiment comprises a plurality of lever determining values. The control system is configured to select one of the lever determining values depending on at least one of the engine rotational speed, engine load, and lever position. Another such embodiment comprises an engine abnormality detection device adapted to detect engine abnormalities in the propulsion units. A failure detection device is adapted to detect failures of the vessel or the propulsion units. The control system is configured to set the first prescribed duration or the second prescribed duration short when receiving an engine abnormality detection signal or a failure detection signal.

In another embodiment the control system has an upper limit set value and a lower limit set value of the engine rotational speed, and the control system is configured to cancel engine synchronization when the engine rotational speed becomes equal to or higher than the upper limit set value or equal to or lower than the lower limit set value.

Another embodiment comprises a plurality of engine speed determining values. The control system is configured to select one of the engine speed determining values depending on at least one of the engine rotational speed, engine load, and lever position.

In accordance with another embodiment, the present invention provides a method for controlling a plurality of propulsion units that are mounted side by side on a vessel and are electrically connected with two adjacent control levers that are controllable by an operator to operate a shift actuator and/or a throttle actuator of a corresponding one of the propulsion units. A first one of the control levers corresponds to a reference propulsion unit. A second one of the control levers corresponds to a target propulsion unit. The method comprises detecting a position of the first control lever, detecting a position of the second control lever, calculating a lever position deviation between the first and second control levers, correcting a throttle opening of the target propulsion unit to synchronize engine rotational speeds between the reference and target propulsion units, detecting an engine rotational speed of the reference propulsion unit, detecting an engine rotational speed of the target propulsion unit, calculating an engine speed deviation between the engine rotational speeds of the reference and target propulsion units, comparing the lever position deviation to a lever determining value, and comparing the engine speed deviation to an engine speed determining value. The method further comprises cancelling engine speed synchronization if the lever position deviation is greater than the lever determining value for greater than a first prescribed duration or if the engine speed deviation is greater than the engine speed determining value for greater than a second prescribed duration.

Another embodiment additionally comprises providing a plurality of first prescribed durations and a plurality of second prescribed durations depending on at least first prescribed durations and one of the second prescribed durations depending on at least one of the engine rotational speed, engine load, and lever position.

DETAILED DESCRIPTION OF PREFERRED EMBODIMENTS

Description is hereinafter made of embodiments of a control device for plural propulsion units. The embodiments discussed herein illustrate certain inventive principles in the context of specific embodiments, and the present invention is not limited to the embodiments discussed herein.

Figure 1:
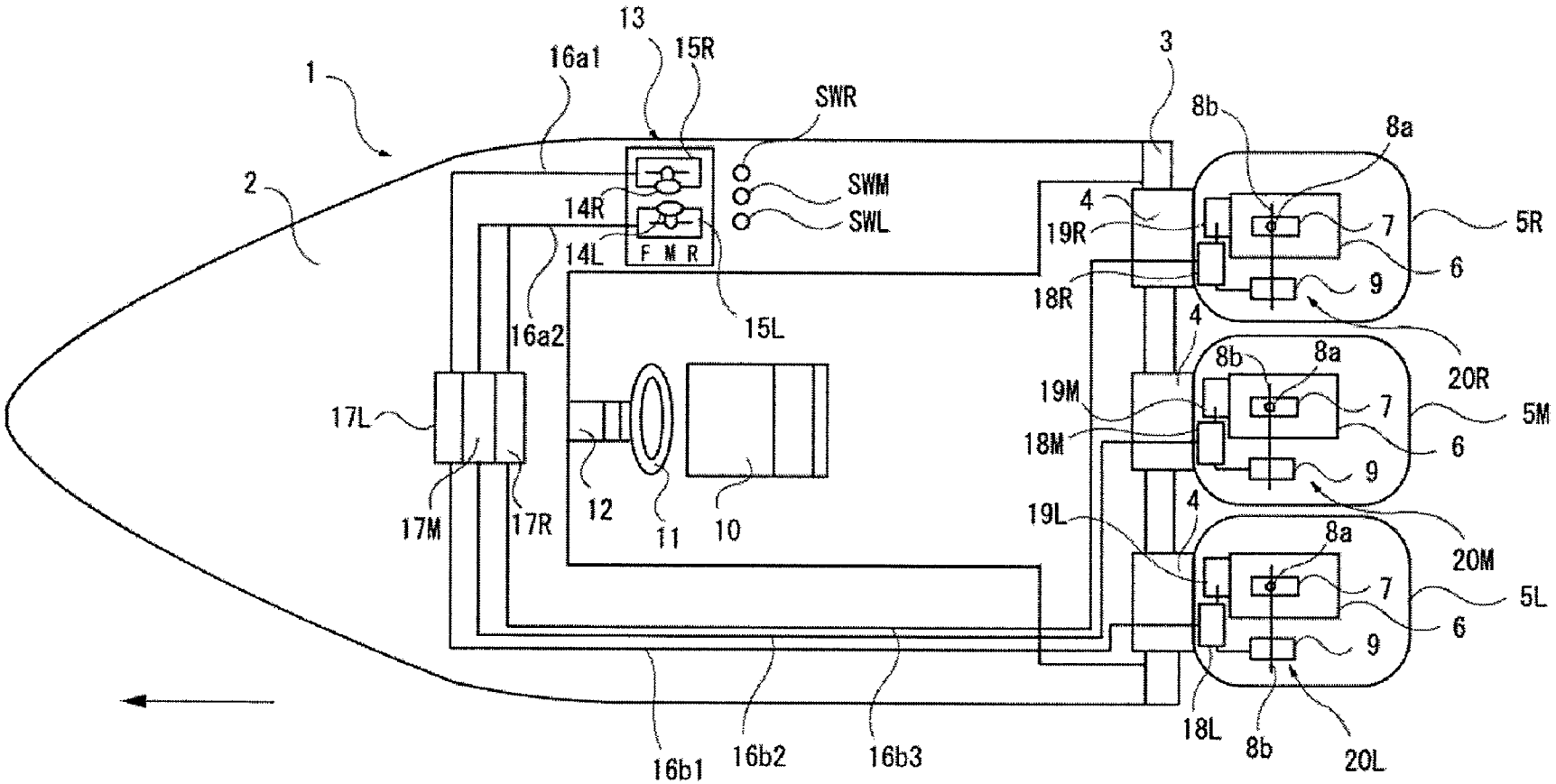
FIG. 1 is a schematic plan view of a vessel provided with an embodiment of a control device for plural propulsion units.
Figure 2:
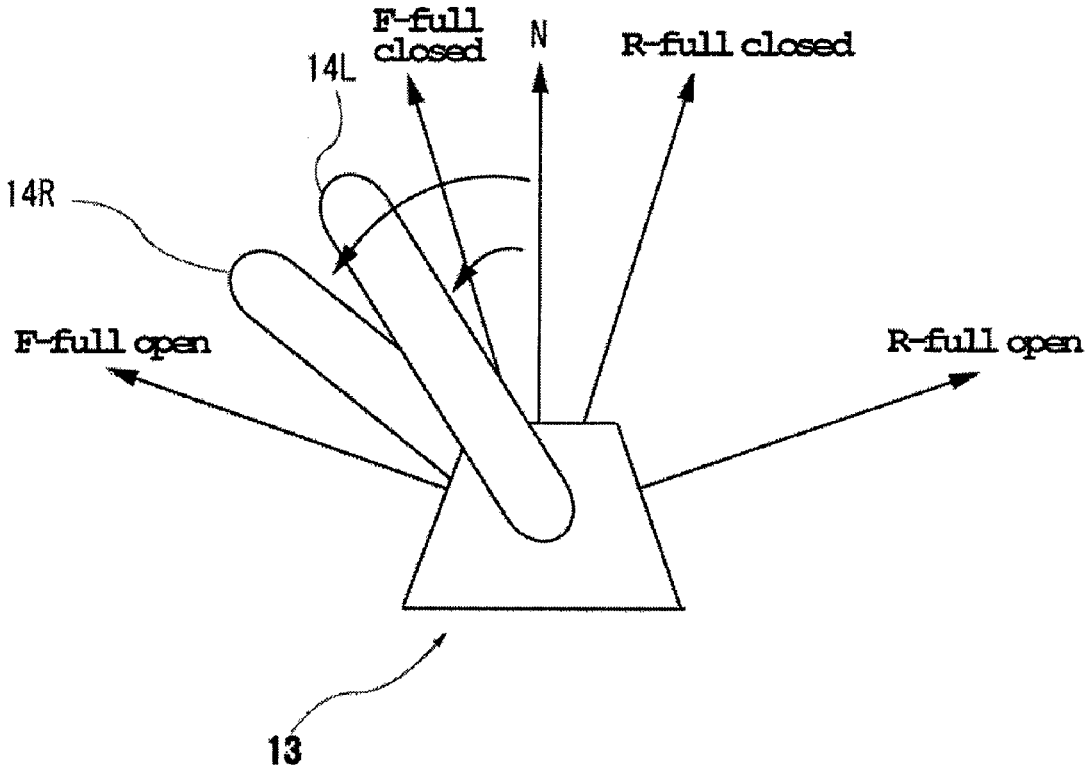
FIG. 2 is a view illustrating an embodiment of a remote controller.

FIG. 1 is a schematic plan view of a vessel provided with a control device for propulsion units according to a preferred embodiment, and FIG. 2 is a view illustrating a remote controller. The vessel of this embodiment, which has three propulsion units on its hull, needs to have a plurality of, that is, at least two propulsion units.

As illustrated, a vessel 1 has a hull 2, and three propulsion units 5L, 5M and 5R each attached to a stem board 3 of the hull 2 via a clamp bracket 4. While outboard motors are used as the propulsion units in this embodiment, the propulsion units may be stem drives, inboard-outboard motors, or other propulsion arrangements. For the sake of explanation, the propulsion unit on the left with respect to the forward travel direction of the vessel indicated by an arrow in FIG. 1 is referred to as "propulsion unit 5L on one side," the propulsion unit on the right is referred to as "propulsion unit 5R on the other side," and the propulsion unit at the center is referred to as "propulsion unit 5M at the center." For example, when the vessel has two propulsion units, the propulsion unit on the left of the two propulsion units on both sides is referred to as "propulsion unit 5L on one side," and the propulsion unit on the right is referred to as "propulsion unit 5R on the other side". When the vessel has four propulsion units, the propulsion unit on the left of the two propulsion units on both sides is referred to as "propulsion unit 5L on one side," the propulsion unit on the right is referred to as "propulsion unit 5R on the other side," and the two propulsion units at the center are referred to as "propulsion units 5M at the canter". A similar arrangement also applies when the vessel has five propulsion units.

Each of the propulsion units 5L, 5M and 5R has an engine 6. Each engine 6 has an air intake system having a throttle body 7 (or carburetor) for adjusting the amount of intake air to be introduced into the engine 6 to control the engine rotational speed and torque of the engine 6. Each throttle body 7 has a motor-operated throttle valve 8*a*. Each throttle valve 8*a* preferably has a valve shaft 8*b* connected to a motor 9. The motor-operated throttle valves 8*a*, which can be opened and closed by driving the motors 9 by electronic control, preferably are electronic throttle mechanisms 20L, 20M and 20R. A manual steering wheel 11 for steering the vessel 1 is provided in front of an operator's seat 10 on the hull 2. The steering wheel 11 is attached to the hull 2 via a steering wheel shaft 12.

A remote controller 13 for controlling the operation of the propulsion units 5L, 5M and 5R is provided on one side of the operator's seat 10. The remote controller 13 has a left remote control lever 14L located on the left side with respect to the forward travel direction of the vessel and a right remote control lever 14R located on the right side, and lever position sensors 15L and 15R for detecting the lever positions of the remote control levers 14L and 14R, respectively. Each of the lever position sensors 15L and 15R is constituted of a potentiometer, for example. Each of the propulsion units 5L, 5M and 5R is operatively and electrically connected to the two remote control levers 14L and 14R arranged adjacent to each other, and has a shift driving device and a throttle driving device operable in light of operator input in positioning the remote control levers 14L and 14R.

That is, the operator changes the shifts (i.e., forward, neutral, reverse) of the propulsion units 5L, 5M and 5R and adjusts the openings of the throttle valves 8*a* of the engines 6 by operating the remote controller 13 preferably by manipulating the remote control levers 14L and 14R to control the traveling speed of the vessel 1 and thrust for acceleration and deceleration. The left remote control lever 14L is provided for changing the shift of the left propulsion unit 5L and for adjustment of the opening of the throttle valve 8*a* (thrust control) of the left propulsion unit 5L. The right remote control lever 14R preferably is provided for changing the shift of the right propulsion unit 5R and for adjustment of the opening of the throttle valve 8*a* (thrust control) of the right propulsion unit 5R. Shift change of the center propulsion unit 5M and adjustment of the opening of the throttle valve 8*a* (thrust control) preferably is made based on the middle position between the position of the left remote control lever 14L and the position of the right remote control lever 14R.

As shown in FIG. 2, when the two remote control levers 14L and 14R are in the center position, the shift is in neutral (N). When the remote control levers 14L and 14R are tilted to the front side from the center position, the shift changed to forward (F) shift. When the remote control levers 14L and 14R are tilted to the rear side from the center position, the shift is changed to reverse (R) shift. When the remote control levers 14L and 14R are tilted further to the front side in the forward (F) shift range, the throttle valves 8*a* open gradually from F-full closed position to F-full open position. When the remote control levers 14L and 14R are tilted further to the rear side in the reverse (R) shift range, the throttle valves 8*a* open gradually from R-full closed position to R-full open position. The operator can therefore control thrust by opening and closing the throttle valves 8*a* both when the vessel is traveling forward and when it is traveling in reverse.

In the illustrated embodiment the remote controller 13 is connected to a remote control part 17L via a communication cable 16*a*1 and to remote control parts 17M and 17R via a communication cable 16*a*2. The remote control parts 17L, 17M and 17R preferably receive information on the lever positions of the remote control levers 14L and 14R outputted from the lever position sensors 15L and 15R, execute a prescribed operation on the lever position information and transmit it to engine control parts 18L, 18M and 18R of the three propulsion units 5L, 5M and 5R. The remote control part 17L and the engine control part 18L are connected via a communication cable 16*b*1, and the remote control parts 17M and 17R and the engine control parts 18M and 18R are connected via communication cables 16*b*2 and 16*b*3, respectively. In the illustrated propulsion units 5L, 5M and 5R, directional changes between forward and reverse and shift changes preferably are made by motor-operated shift mechanisms 19L, 19M and 19R attached to the engines 6.

On one side of the operator's seat 10 in the illustrated embodiment, a main switch SWL, a main switch SWM and a main switch SWR are located at the left, center and right in the vicinity of the remote controller 13. The main switches SWL, SWM and SWR correspond to the propulsion units 5L, 5M and 5R, respectively, and the engines 6 of the propulsion units 5L, 5M and 5R are started by operating the main switches SWL, SWM and SWR, respectively. In addition, a steering drive device (not shown) for rotating the propulsion units about swivel shafts (not shown) thereof according to the operative angle of the manual steering wheel 11 preferably is provided on the hull 2.

Figure 3:
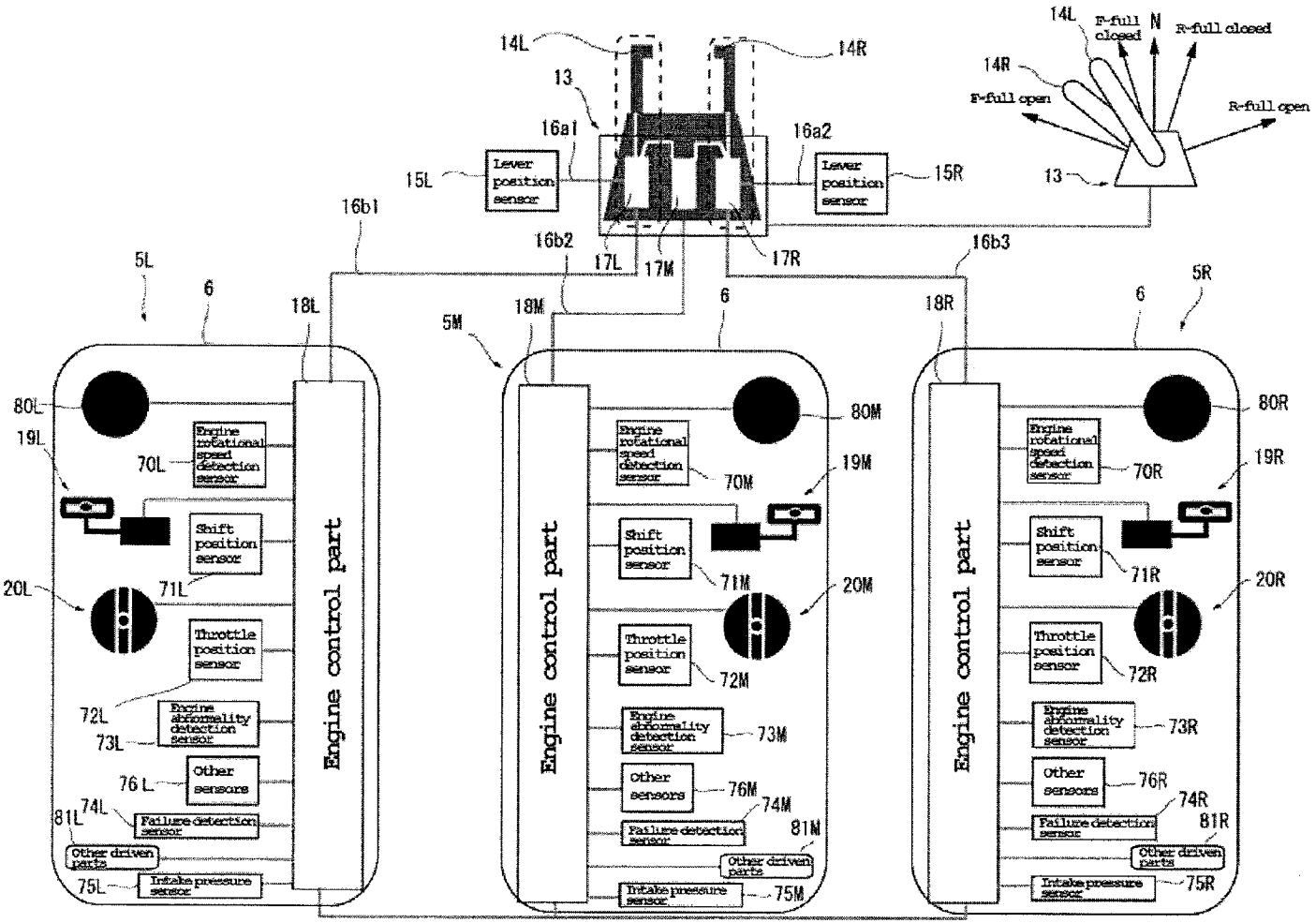
FIG. 3 is a system chart of one embodiment of a control device for plural propulsion units.

FIG. 3 is a system chart of the control device for propulsion units in accordance with one preferred embodiment. The engine control part 18L of the left propulsion unit 5L drives a flywheel 80L, the motor-operated shift mechanism 19L, the electronic throttle mechanism 20L, and other driven parts 81L. The engine control part 18L preferably includes an engine control unit (ECU), and the other driven parts 81L include an exhaust cam, an oil control valve and so on. To the engine control part 18L preferably are connected an engine rotational speed detection sensor 70L, a shift position sensor 71L, a throttle position sensor 72L, an engine abnormality detection sensor 73L, a failure detection sensor 74L, an intake pressure sensor 75L, and other sensors 76L. The other sensors 76L preferably include, for example, a camshaft sensor, a thermosensor, and so on.

When the engine 6 is driven and the crankshaft rotates, the engine rotational speed detection sensor 70L obtains engine rotational speed information from rotation of the flywheel 80L mounted on the crankshaft and inputs it into the engine control part 18L. The shift position sensor 71L obtains information on the shift position (forward, reverse or neutral) from the drive of the motor-operated shift mechanism 19L and inputs it into the engine control part 18L. The throttle position sensor 72L obtains throttle opening information from the drive of the electronic throttle mechanism 20L and inputs it into the engine control part 18L. The engine abnormality detection sensor 73L detects engine abnormalities in the engine 6 of the left propulsion unit 5L such as overheat and a drop in engine oil level. The failure detection sensor 74L detects failures of the remote controller 13 of the vessel or the shift driving device, the throttle driving device and so on of the left propulsion unit 5L.

The engine control part 18R of the right propulsion unit 5R drives a flywheel 80R, the motor-operated shift mechanism 19R, the electronic throttle mechanism 20R, and other driven parts 81R, and detection information is inputted into the engine control part 18R from the engine rotational speed detection sensor 70R, a shift position sensor 71R, a throttle position sensor 72R, an engine abnormality detection sensor 73R, a failure detection sensor 74R, an intake pressure sensor 75R, and other sensors 76R. The engine control part 18M of the center propulsion unit 5M drives a flywheel 80M, the motor-operated shift mechanism 19M, the electronic throttle mechanism 20M, and other driven parts 81M, and detection information is inputted into the engine control part 18M from the engine rotational speed detection sensor 70M, a shift position sensor 71M, a throttle position sensor 72M, an engine abnormality detection sensor 73M, a failure detection sensor 74M, an intake pressure sensor 75M, and other sensors 76M. The engine control part 18R and the engine control part 18M, each of which preferably include an engine control unit (ECU) just as the engine control part 18L, and the driven parts and the sensors of the engine control parts 18M and 18R, which preferably are constituted similarly to those of the engine control part 18L, transmit and receive obtained information.

The control device for propulsion units preferably operates the shift driving devices and the throttle driving devices in light of operation of the two remote control levers 14L and 14R to synchronize the engine rotational speeds of the propulsion units. In one preferred embodiment, a control for the synchronization of the engine rotational speeds of the right propulsion unit 5R and the center propulsion unit 5M therewith is executed based on the engine rotational speed of the left propulsion unit 5L. Of course, other embodiments are contemplated. For example, a control for the synchronization of the engine rotational speeds of the left propulsion unit 5L and the center propulsion unit 5M therewith may be executed based on the engine rotational speed of the right propulsion unit 5R. Additionally, a control for the synchronization of the engine rotational speed of the left propulsion unit 5L and the right propulsion unit 5R therewith may be executed based on the engine rotational speed of the center propulsion unit 5M. When the control device for propulsion units are installed in the vessel, it preferably is determined which propulsion unit should be used as a reference and which propulsion units should be the targets of synchronization.

Figure 4:
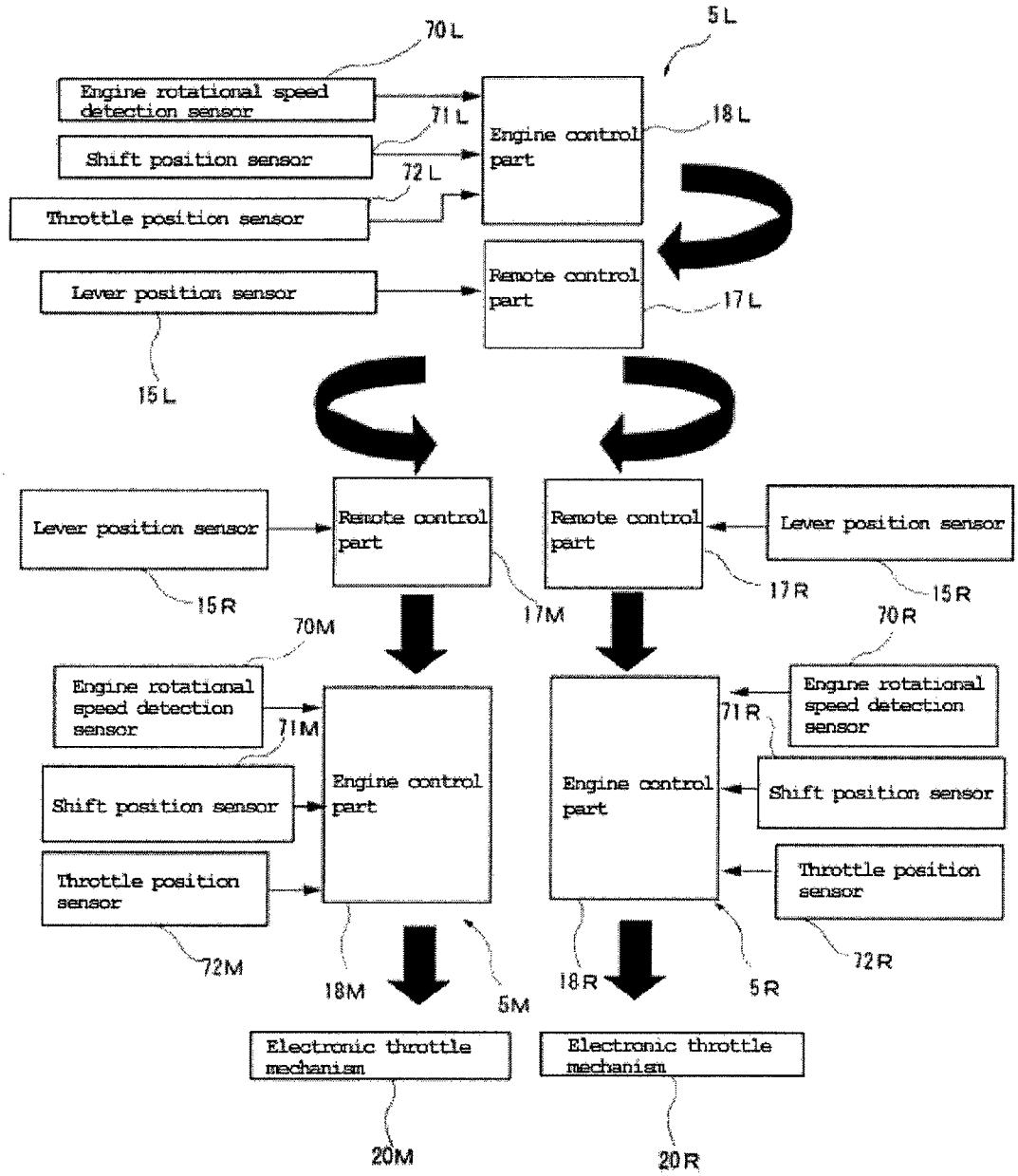
FIG. 4 is a schematic system chart of the control device of FIG. 3.
Figure 5:
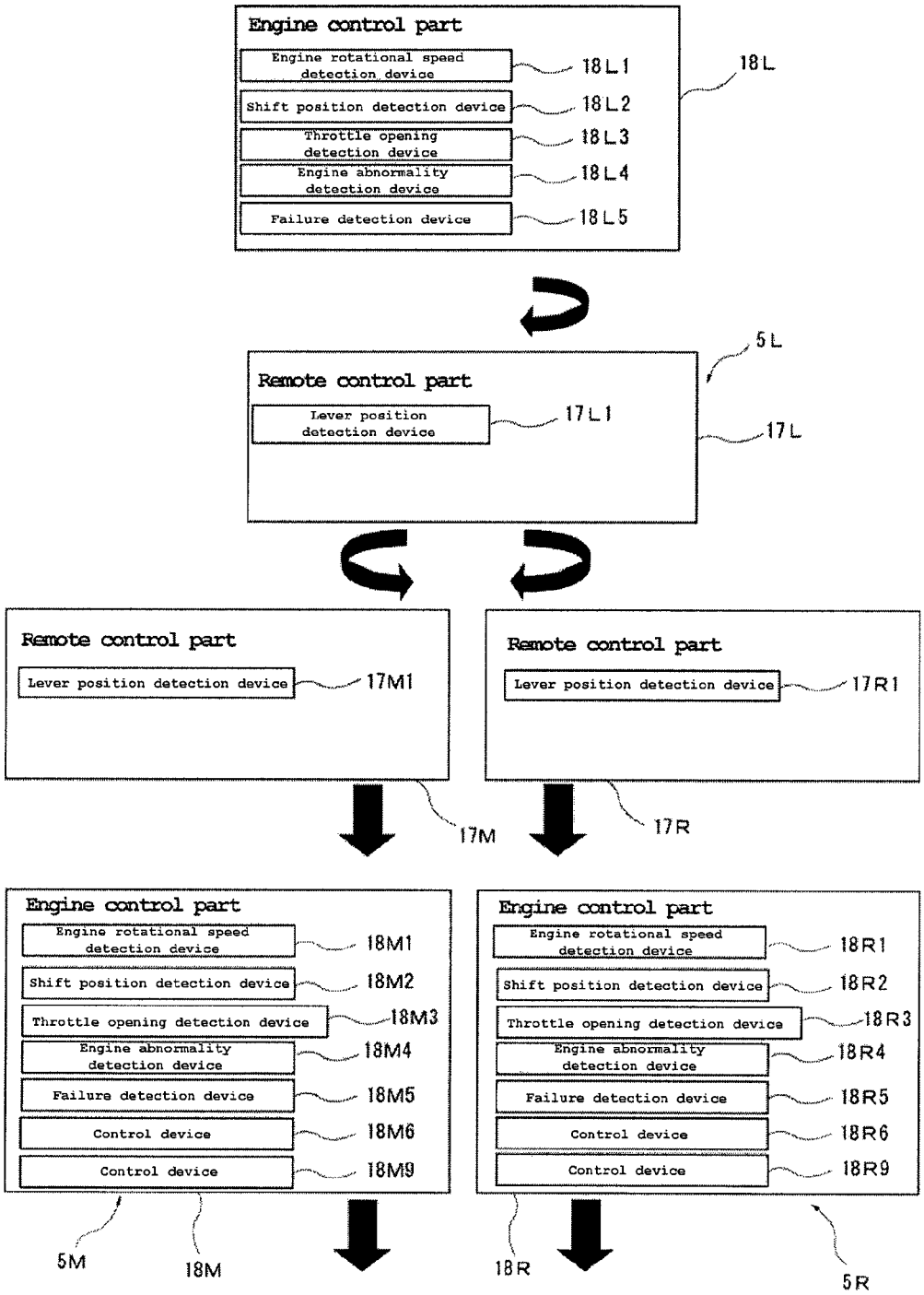
FIG. 5 is a view illustrating the configuration of the remote control parts and the engine control parts in accordance with an embodiment.
Figure 6:
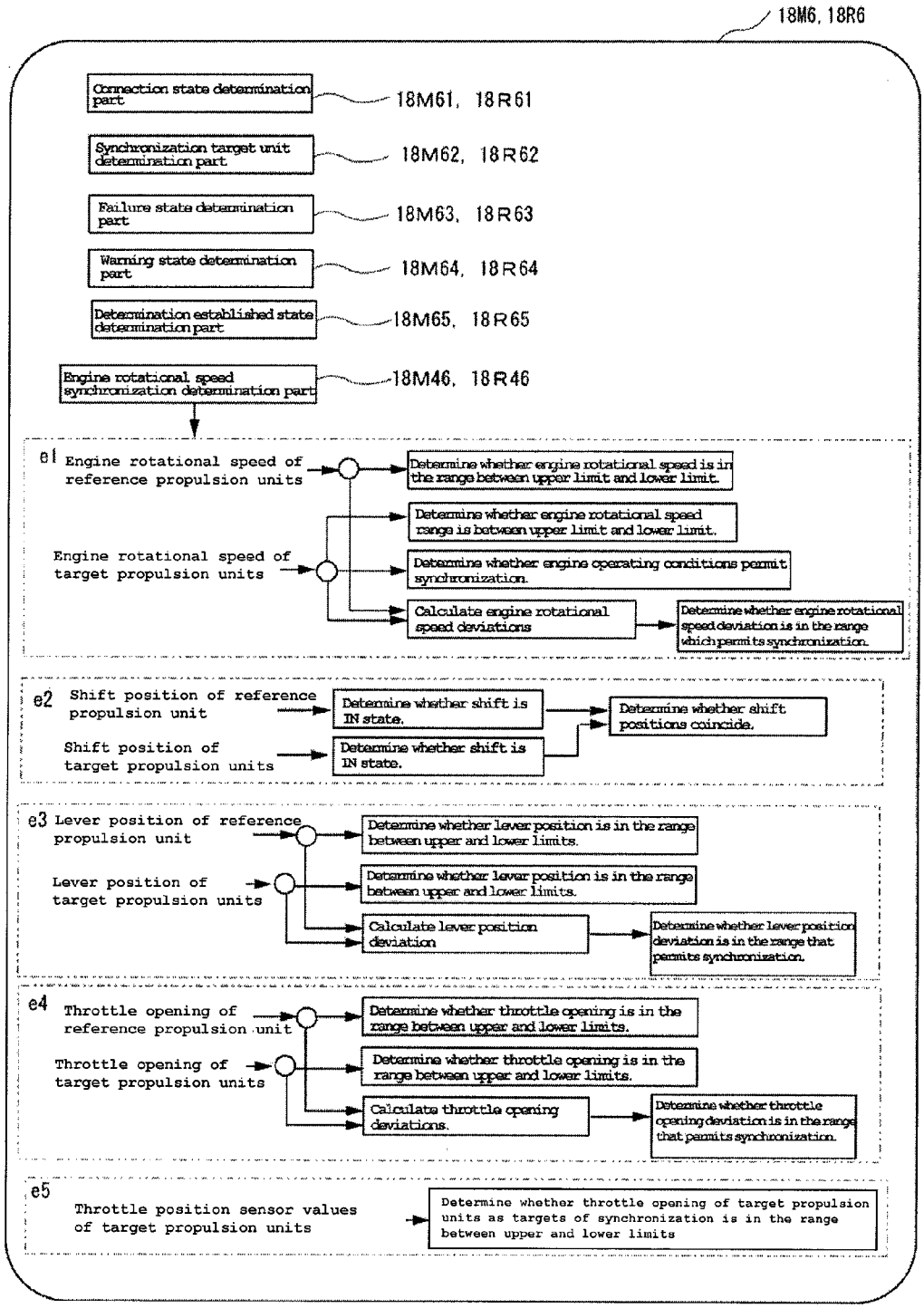
FIG. 6 is a view illustrating a rotation synchronizing control determination.
Figure 7:
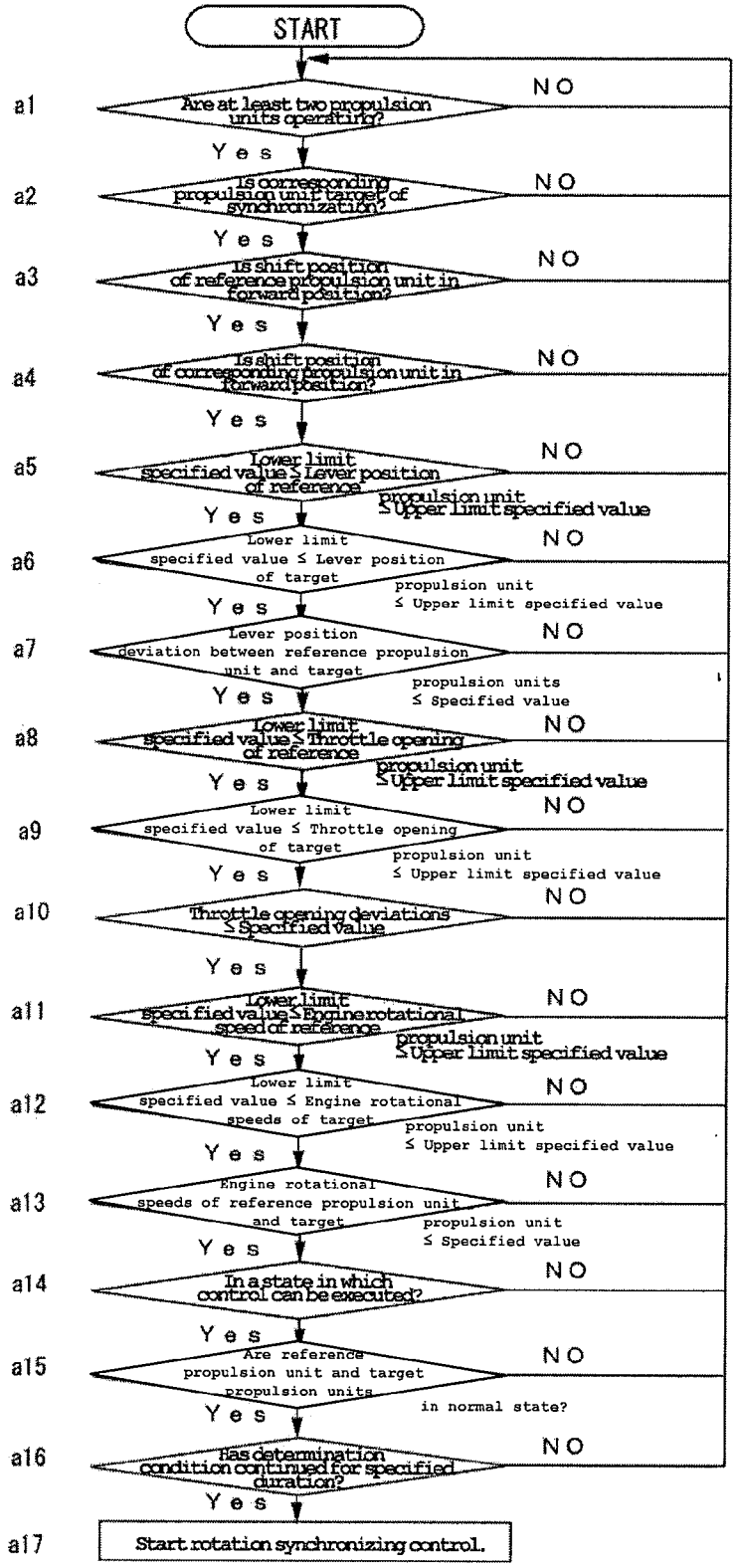
FIG. 7 is a flowchart of the rotation synchronizing control determination of FIG.6.
Figure 8:
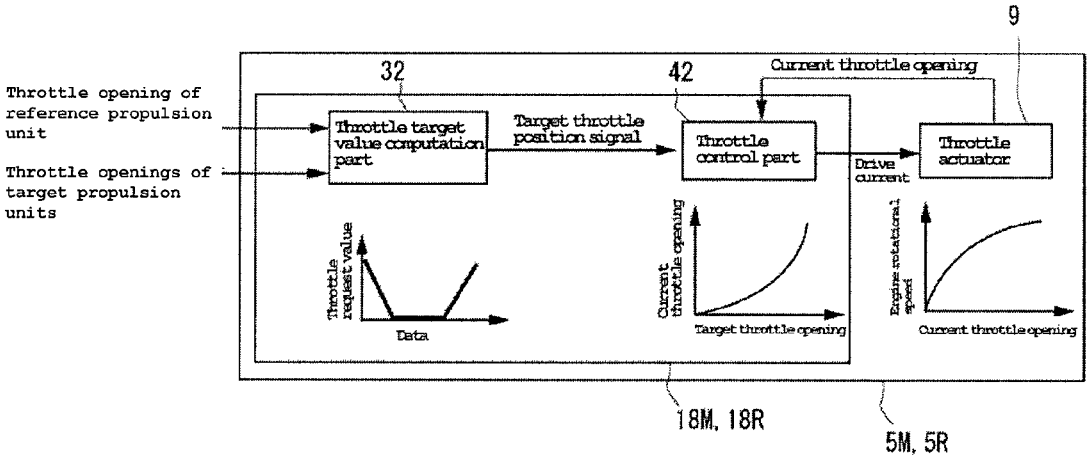
FIG. 8 is a block diagram of a rotation synchronizing control.

An embodiment of control for the synchronization of the engine rotational speeds of the propulsion units is described with reference to FIG. 4 to FIG. 8. FIG. 4 is a schematic system chart of the control device for propulsion units, FIG. 5 is a view illustrating the configuration of the remote control parts and the engine control parts, FIG. 6 is a view illustrating a rotation synchronizing control determination, FIG. 7 is a flowchart of the rotation synchronizing control determination, and FIG. 8 is a block diagram of a rotation synchronizing control.

With initial reference to FIG. 4, a lever position sensor value is inputted as a voltage value into the remote control part 17L of the reference propulsion unit 5L from the lever position sensor 15L. A lever position sensor value is also inputted as a voltage value from the lever position sensor 15R into the remote control parts 17M and 17R of the propulsion units 5M and 5R, which in the illustrated embodiment are the targets of synchronization (hereinafter "target propulsion units").

In a preferred embodiment, a sensor value is inputted as a pulse number into the engine control part 18L of the reference propulsion unit 5L from the engine rotational speed detection sensor 70L, and sensor values are inputted as voltage values into the engine control part 18L of the reference propulsion unit 5L from the shift position sensor 71L and the throttle position sensor 72L. Information obtained from the sensor values is transmitted to the remote control part 17L and then to the remote control parts 17M and 17R.

Sensor values preferably are also inputted into the engine control parts 18M and 18R of the target propulsion units 5M and 5R from the engine rotational speed detection sensors 70M and 70R, the shift position sensors 71M and 71R, and the throttle position sensors 72M and 72R, respectively. The engine control parts 18M and 18R drive the electronic throttle mechanisms 20M and 20R, respectively, based on information obtained from the sensor values and information transmitted to the remote control parts 17M and 17R.

The configuration of the remote control parts 17L, 17M and 17R and the engine control parts 18L, 18M and 18R is next described with reference to FIG. 5. The remote control part 17L of the reference propulsion unit 5L preferably has a lever position detection device 17L1. The lever position detection device 17L1 detects the lever position of the remote control lever 14L for the reference propulsion unit 5L based on a lever position sensor value. In this embodiment, a lever position is the angle by which the lever is tilted from the neutral position to the forward or reverse side. It is to be understood that, in other embodiments, an operating device such as joystick or slide volume can be used as the control lever.

The engine control part 18L of the reference propulsion unit 5L in the illustrated embodiment has an engine rotational speed detection device 18L1, a shift position detection device 18L2, a throttle opening detection device 18L3, an engine abnormality detection device 18L4, and a failure detection device 18L5. The engine rotational speed detection device 18L1 obtains an engine rotational speed from a sensor value from the engine rotational speed detection sensor 70L, the shift position detection device 18L2 obtains a shift position from a sensor value from the shift position sensor 71L, and the throttle opening detection device 18L3 obtains a throttle opening from a sensor value of the throttle position sensor 72L. The engine abnormality detection device 18L4 detects engine abnormalities in the engine 6 of the propulsion unit 5L such as overheat or a drop in engine oil level based on a sensor signal from the engine abnormality detection sensor 73L of the reference propulsion unit 5L. The failure detection device 18L5 detects failures of the remote controller 13 of the vessel or the shift driving device, the throttle driving device and so on of the left propulsion unit 5L based on a sensor signal from the failure detection sensor 18L5. The information on engine rotational speed, shift position, and throttle opening and the information on engine abnormalities, and failures are transmitted from the engine control part 18L to the remote control part 17L.

The remote control parts 17M and 17R of the target propulsion units 5M and 5R have lever position detection devices 17M1 and 17R1, respectively. The lever position detection devices 17M1 and 17R1 detect the lever position of the remote control lever 14R for the target propulsion units 5M and 5R. In this embodiment, a lever position is the angle by which the lever is tilted from the neutral position to the forward or reverse side. In other embodiments, an operating device such as joystick or slide volume can be used as the control lever. The information on the lever position, shift position, throttle opening, and engine rotational speed of the reference propulsion unit 5L is inputted from the remote control part 17L into the remote control parts 17M and 17R.

In the illustrated embodiment, the engine control parts 18M and 18R of the target propulsion units 5M and 5R have engine rotational speed detection devices 18M1 and 18R1, shift position detection devices 18M2 and 18R2, throttle opening detection devices 18M3 and 18R3, engine abnormality detection devices 18M4 and 18R4, and failure detection devices 18M5 and 18R5, respectively. The engine rotational speed detection devices 18M1 and 18R1 obtain an engine rotational speed from a sensor value from the engine rotational speed detection sensor 70M and 70R, respectively, the shift position detection devices 18M2 and 18R2 obtain a shift position from a sensor value from the shift position sensors 71M and 71R, respectively, and the throttle opening detection devices 18M3 and 18R3 obtain a throttle opening from a sensor value from the throttle position sensors 72M and 72R, respectively. The engine abnormality detection devices 18M4 and 18R4 detect engine abnormalities in the engines 6 of the target propulsion units 5M and 5R such as overheat or a drop in engine oil level based on a sensor signal from the engine abnormality detection sensors 73M and 73R of the propulsion units 5M and 5R, respectively. The failure detection devices 18M5 and 18R5 detect failures of the remote controller 13 of the vessel or the shift driving device, the throttle driving device and so on of the propulsion units 5M and 5R based on a sensor signal from the failure detection sensors 74M and 74R, respectively.

The engine control parts 18M and 18R preferably have control devices 18M6 and 18R6 and control devices 18M9 and 18R9, respectively. Information on lever position, shift position, throttle opening, and engine rotational speed of the reference propulsion unit 5L and information on engine rotational speed, shift position, and throttle opening of the target propulsion units 5M and 5R are inputted into the control devices 18M6 and 18R6, and the control devices 18M6 and 18R6 execute a control for synchronization of the engine rotational speeds of the propulsion units.

The configuration of an embodiment of the control devices 18M6 and 18R6 is described with reference to FIG. 6. The control devices 18M6 and 18R6, which preferably are constituted similarly, execute the following determinations and execute a control for the synchronization of the engine rotational speeds of the propulsion units.

Connection state determination parts 18M61 and 18R61 determine whether the reference propulsion unit 5L is in a connected state based on information on lever position, shift position, throttle opening, engine rotational speed and so on of the reference propulsion unit 5L.

Synchronization target unit determination parts 18M62 and 18R62 determine whether the propulsion units 5M and 5R corresponding thereto are targets of synchronization based on information on lever position, shift position, throttle opening, engine rotational speed and so on of the propulsion units 5M and 5R as targets of synchronization.

Since a protective control such as stopping the engines is executed based on a failure signal from failure detection device for detecting failures of the vessel or the propulsion units, failure state determination parts 18M63 and 18R63 determine the presence or absence of a protective control as a determination condition, and the control for the synchronization of the engine rotational speeds of the propulsion units is executed when no protective control is executed. When a sensor or actuator in systems of the propulsion units has a failure, it may make the rotation synchronizing control impossible. Thus, a protective control for systems of a plurality of propulsion units is determined as a determination condition of the rotation synchronizing control to achieve a safe and stable rotation synchronizing control.

Since a warning control such as decreasing the engine rotational speeds is executed based on detection of an engine abnormality based on an abnormality signal from the engine abnormality detection device for detecting engine abnormalities of the propulsion units, warning state determination parts 18M64 and 18R64 determine the presence or absence of a warning control as a determination condition, and the control for the synchronization of the engine rotational speeds of the propulsion units is not executed when a warning control is executed. Since the presence or absence of a warning control is determined as a determination condition, and the control for the synchronization of the engine rotational speeds of the propulsion units is not executed when a warning control is executed as described above, the vessel is slowed down to protect the engines when a warning of overheat or a drop in hydraulic pressure is provided. The presence or absence of a warning control is determined as a determination condition of a rotation synchronizing control to protect the engines when a warning is provided.

In some embodiments, established state determination parts 18M65 and 18R65 determine the duration for which the determination conditions have continued as an execution condition of the control for the synchronization of the engine rotational speeds. When the determination conditions have continued for a prescribed duration, the control for the synchronization of the engine rotational speeds of the propulsion units is executed. In the environment in which the propulsion units are used, the engine load conditions are changed by various factors such as waves and tides, and the determination conditions may sometimes be satisfied for only a moment. Thus, the duration for which the determination conditions have continued is determined as an execution condition of the control for the synchronization of the engine rotational speeds, and the control for the synchronization of the engine rotational speeds is executed when the determination conditions have continued for a prescribed duration. This is conducive to achieving a stable rotation synchronizing control.

The execution condition is set based on the lever positions of the control levers, and the control for the synchronization of the engine rotational speeds of the propulsion units is executed when the lever positions are beyond a specified position. When a vessel is steered using a plurality of propulsion units, especially in a low speed condition, the control levers are thought to be operated frequently to change directions or make turns during traveling at a low speed. However, the operator usually wants to synchronize the engine rotational speeds quickly and precisely when speeds are in the cruising range. Thus, in some embodiments a specified duration as a determination condition is set long when the lever position, that is, the lever angle, is small and the engine rotational speed is low (for example, when the lever angle is 10° to 20° and the engine rotational speed is 3000 rpm or lower), and the specified duration is set short when the lever angle is large and the engine rotational speed is in the cruising range (for example, when the lever angle is 20° or larger and the engine rotational speed is 3000 rpm to 5000 rpm). Since an execution condition is set based on the lever positions of the control levers and the control for the synchronization of the engine rotational speeds of the propulsion units is executed when the lever positions are beyond a specified position as described above, a rotation synchronizing control in accordance with the steering intention of the operator can be achieved.

Engine rotational speed synchronization determination parts 18M46 and 18R46 make a determination to execute the control for the synchronization of the engine rotational speeds of the propulsion units as described below, and with reference to FIG. 6.

In step e1, it is determined whether the engine rotational speed of the reference propulsion unit is in the range between an upper limit rotational speed and a lower limit rotational speed, and it is determined whether the engine rotational speeds of the target propulsion units are in the range between the upper limit rotational speed and the lower limit rotational speed. For example, in one embodiment the upper limit rotational speed and the lower limit rotational speed of the engine rotational speeds are 6000 rpm and 500 rpm, respectively. As described above, the upper limit rotational speed of the engine rotational speed of one of the propulsion units is determined as a determination condition of the control for synchronization, and, when the engine rotational speeds are equal to or lower than the upper limit rotational speed, the control for the synchronization of the engine rotational speeds of the propulsion units is allowed.

Also, the lower limit rotational speed of the engine rotational speed of one of the propulsion units is determined as a determination condition of the control for synchronization, and, when the engine rotational speed is equal to or higher than the lower limit rotational speed, the control for the synchronization of the engine rotational speeds of the propulsion units is allowed.

It is determined, based on the engine rotational speeds of the propulsion units as targets of synchronization, whether the operating conditions of the engines permit the control for the synchronization of the engine rotational speeds to be executed. If the conditions permit, the control for the synchronization of the engine rotational speeds of the propulsion units is allowed.

Also, deviations in engine rotational speed are calculated from the engine rotational speed of the reference propulsion unit 5L and the engine rotational speeds of the target propulsion units 5M and 5R, and it is determined whether the deviations in engine rotational speed are in a deviation range of engine rotational speed which permits synchronization. When the deviations are in the deviation range, the control for the synchronization of the engine rotational speeds of the propulsion units is allowed.

The upper limit rotational speeds of the engine rotational speeds may differ because of the variation in engine rotational speed or variation in engine load due to the difference in installation positions of a plurality of propulsion units. When the upper limit rotational speed as a reference is lowest in those of a plurality of propulsion units and the engine rotational speeds are synchronized based on it, the total output is suppressed. Thus, in one embodiment the engine rotational speed of one of the propulsion units is determined as a determination condition, and the control for the synchronization of the engine rotational speeds of the propulsion units is executed when the engine rotational speed is equal to or lower than an upper limit rotational speed. An upper limit rotational speed for the rotation synchronizing control is set to increase the total output of a plurality of propulsion units.

In engine control at a time when the throttle openings are small, a control for achieving an idle rotational speed by correction of throttle opening and/or ignition timing is executed. Thus, when the engine rotational speed of one of the propulsion units is determined as a determination condition, a control for the synchronization of the engine rotational speeds of the propulsion units is executed when the engine rotational speed is equal to or higher than a lower limit rotational speed, and a lower limit rotational speed for a rotation synchronizing control is determined to select a control suitable for the operating speed so that control for the idle rotational speed and a rotation synchronizing control cannot be executed simultaneously, stable rotations of the engines can be achieved.

In step e2, based on the shift position of the control lever for the reference propulsion unit, the shift input state thereof is determined, and, based on the shift position of the control lever for the target propulsion units, the shift input state thereof is determined. If they are in an input state, it is determined whether their shift positions coincide with each other as a determination condition of a control for the synchronization of the engine rotational speeds. If the shift positions coincide with each other, the control for the synchronization of the engine rotational speeds of the propulsion units is allowed. When the shift positions of a plurality of propulsion units are different, the engine load conditions are different, which makes rotation synchronization difficult and does not meet the intention to achieve smooth cruising. Thus, coincidence of the shift positions preferably is determined as a determination condition of the control for synchronization of the engine rotational speeds, and the control for the synchronization of the engine rotational speeds of the propulsion units is executed when the shift positions coincide with each other to carry out a rotation synchronizing control in accordance with the intention of the operator to synchronize the engine rotational speeds of a plurality of propulsion units.

In step e3, a deviation between the lever position of the control lever for the reference propulsion unit and the lever position of the control lever for the target propulsion units is computed, and the deviation in lever position is determined as a determination condition. When the deviation in lever position is equal to or smaller than a specified value, control for the synchronization of the engine rotational speeds of the propulsion units is allowed. The deviation specified value between lever positions, that is, the lever angles, is, for example, 5° in a preferred embodiment. In other embodiments, the deviation value may be greater or lesser, and may differ based on certain conditions such as engine speed and the like. The deviation in lever position preferably is determined as a determination condition. Specifically, it is determined whether the control levers for a plurality of propulsion units are in substantially the same angular position. A control for the synchronization of the engine rotational speeds of the propulsion units is executed when the deviation is equal to or smaller than a specified value as described above to carry out a rotation synchronizing control in accordance with the intention of the operator to synchronize the engine rotational speeds of a plurality of propulsion units.

In step e4, deviations between the throttle opening of the reference propulsion unit and the throttle openings of the target propulsion units are computed. The deviations in throttle opening preferably are also determined as a determination condition, and the control for the synchronization of the engine rotational speeds of the propulsion units is allowed when the deviations are equal to or smaller than a specified value. The deviation specified value in throttle opening are, for example, 5° in one preferred embodiment, although other embodiments may use greater or lesser such values, including using differing values in differing conditions. The deviations in throttle opening as a determination condition are determined based on the throttle openings for air amount adjustment to determine the outputs of the propulsion units, and a control for the synchronization of the engine rotational speeds of the propulsion units is executed when the deviations are equal to or smaller than a specified value as described above to carry out a stable rotation synchronizing control for the synchronization of the engine rotational speeds of a plurality of propulsion units.

Also, it is determined whether the throttle opening of the reference propulsion unit 5L is in the range between an upper limit and a lower limit and whether the throttle openings of the target propulsion units 5M and 5R are in the range between the upper limit and the lower limit. The throttle openings are determined as a determination condition to allow the control for synchronizing the engine rotational speeds of the propulsion units.

In step e5, it is determined whether throttle openings obtained from throttle position sensor values of the target propulsion units 5M and 5R are in the range between an upper limit and a lower limit. The throttle openings preferably are determined as a determination condition to allow the control for the synchronization of the engine rotational speeds of the propulsion units.

The flowchart of rotation synchronizing control determination shown in FIG. 7 is next described.

In step a1, the control devices 18M4 and 18R4 of the target propulsion units 5M and 5R determine whether the reference propulsion unit 5L is in a connected state based on information about the reference propulsion unit 5L such as lever position, shift position, throttle opening, and engine rotational speed to determine whether at least two propulsion units are operating.

In step a2, if at least two propulsion units are operating, it is determined whether its corresponding propulsion unit is the target propulsion unit 5M or the target propulsion unit 5R.

In step a3, it is determined whether the shift position of the reference propulsion unit 5L is in the forward position if its corresponding propulsion unit is the target propulsion unit 5M or the target propulsion unit 5R.

In step a4, if the shift position of the reference propulsion unit 5L is in the forward position, it is determined whether the shift position of its corresponding target propulsion unit 5M or 5R is in the forward position.

In step a5, it is determined whether the lever position of the reference propulsion unit 5L is in the range between a lower limit specified value and an upper limit specified value if the shift position of its corresponding target propulsion unit 5M or 5R is in the forward position.

In step a6, if the lever position of the reference propulsion unit 5L is in the range between a lower limit specified value and an upper limit specified value, it is determined whether the lever position of the target propulsion units 5M and 5R is in the range between a lower limit specified value and an upper limit specified value.

In step a7, if the lever position of the target propulsion units 5M and 5R is in the range between a lower limit specified value and an upper limit specified value, it is determined whether the deviation in lever position is equal to or smaller than a specified value.

In step a8, if the deviation in lever position is equal to or smaller than a specified value, it is determined whether the throttle opening of the reference propulsion unit 5L is in the range between a lower limit specified value and an upper limit specified value.

In step a9, if the throttle opening of the reference propulsion unit 5L is in the range between a lower limit specified value and an upper limit specified value, it is determined whether the throttle openings of the target propulsion units 5M and 5R are in the range between a lower limit specified value and an upper limit specified value.

In step a10, if the throttle openings of the target propulsion units 5M and 5R are in the range between a lower limit specified value and an upper limit specified value, it is determined whether the deviations in throttle opening are equal to or smaller than a specified value.

In step a11, if the deviations in throttle opening are equal to or smaller than a specified value, it is determined whether the engine rotational speed of the reference propulsion unit 5L is in the range between a lower limit rotational speed and an upper limit rotational speed.

In step a12, if the engine rotational speed of the reference propulsion unit 5L is in the range between a lower limit rotational speed and an upper limit rotational speed, it is determined whether the engine rotational speeds of the target propulsion units 5M and 5R are in the range between a lower limit rotational speed and an upper limit rotational speed.

In step a13, if the engine rotational speeds of the target propulsion units 5M and 5R are in the range between a lower limit rotational speed and an upper limit rotational speed, it is determined whether the deviations in engine rotational speed are equal to or smaller than a specified value.

In step a14, if the deviations in engine rotational speed are equal to or smaller than a specified value, the presence or absence of a warning control in each propulsion unit is determined as a determination condition, and, when a warning control is executed, the control for the synchronization of the engine rotational speeds of the propulsion units is not executed.

In step a15, a protective control is executed based on failure signals from the failure detection device for detecting failures of the vessel or each propulsion unit, and the presence or absence of a protective control is determined as a determination condition. When a protective control is not executed, the control for the synchronization of the engine rotational speeds of the propulsion units is executed.

In step a16, the duration for which the determination condition has continued is determined as an execution condition of a control for the synchronization of the engine rotational speed. When the determination condition has continued for a prescribed duration, a control for the synchronization of the engine rotational speeds is executed.

In step a17, if the determination condition has continued for a prescribed duration, a control for the synchronization of the engine rotational speeds is executed.

The control for the synchronization of the engine rotational speeds of the propulsion units is described with reference to the block diagram of a rotation synchronizing control in FIG. 8.

An example in which a target position of the engine control for the target propulsion units 5M and 5R is set is described below with reference to FIG. 8. Each of the engine control parts 18M and 18R of the target propulsion units 5M and 5R has a throttle target value computation part 32 and a throttle control part 42. Data of throttle opening of the reference propulsion unit 5L and throttle openings of the target propulsion units 5M and 5R are inputted into the throttle target value computation parts 32, throttle request values of the propulsion units 5M and 5R corresponding to the data are computed therein, and target throttle position signals are outputted therefrom. The throttle control parts 42 compare current throttle opening information based on feedback signals provided as feedbacks from electronic throttles (that is, the motors 9 in some embodiments) of throttle actuators and target throttle opening information from the throttle target value computation parts 32, and output target throttle opening signals so as to achieve target throttle openings. A drive current is thereby outputted in a preferred embodiment so as to achieve the target throttle openings, and the electronic throttles (for example, the motors 9) of the throttle actuators are driven to achieve a prescribed engine rotational speed.

Figure 9:
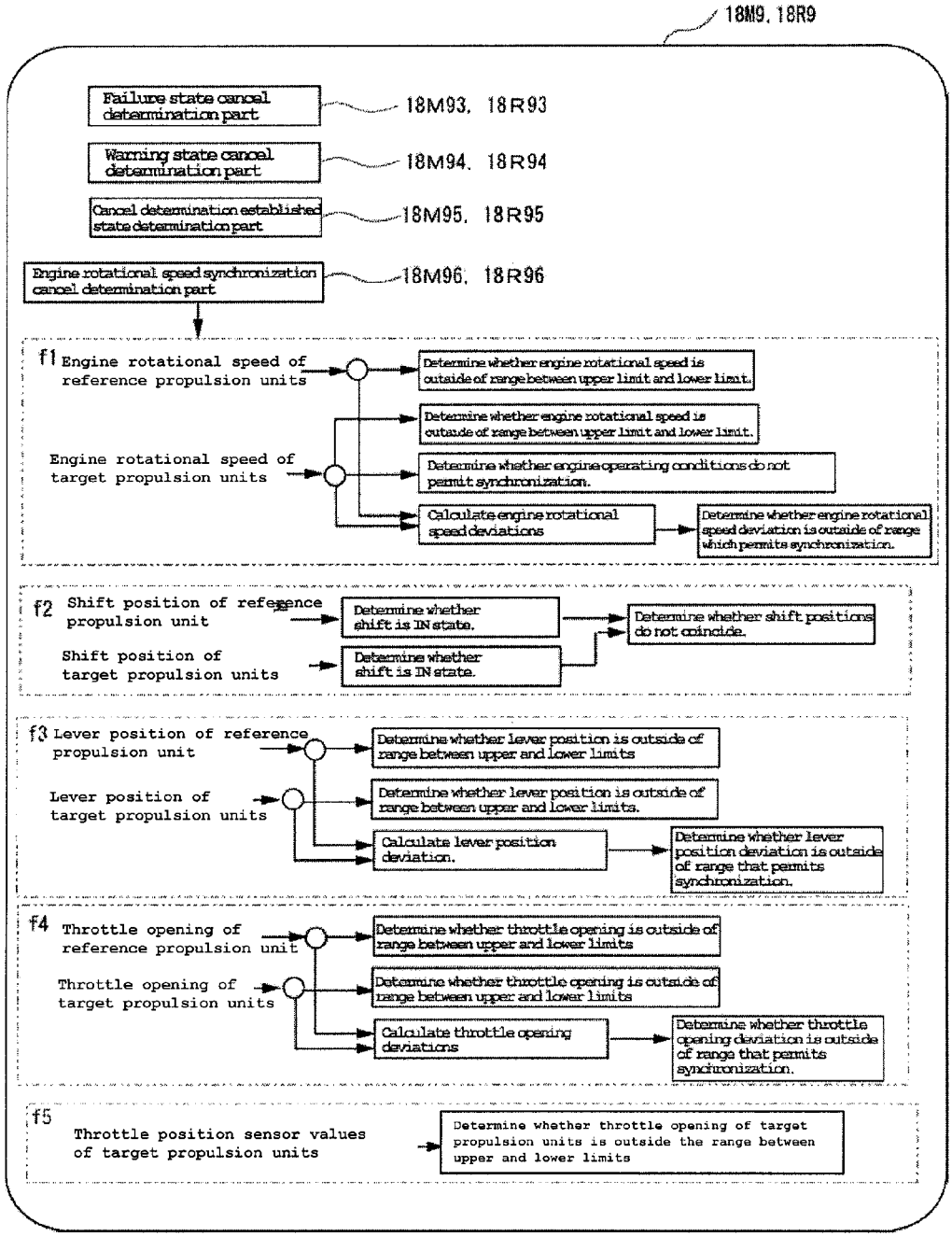
FIG. 9 is a diagram illustrating a rotation synchronizing control cancel determination in accordance with an embodiment.
Figure 10:
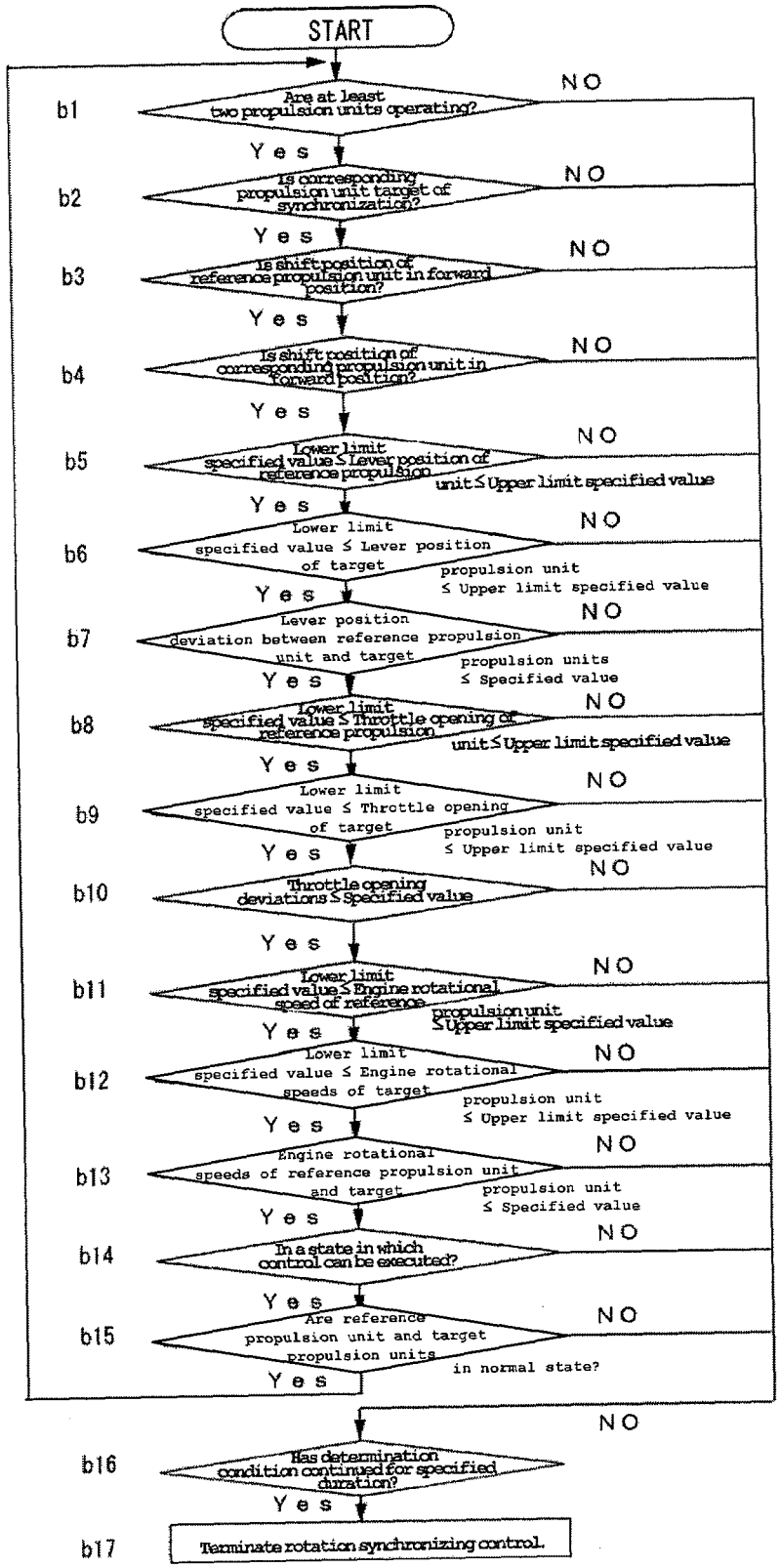
FIG. 10 is a flowchart of an embodiment of a rotation synchronizing control cancel determination.

With reference next to FIGS. 9 and 10, control devices 18M9 and 18R9 are described. The control devices 18M9 and 18R9 preferably selectively cancel the synchronizing control in the control device for propulsion units. FIG. 9 is a view illustrating an embodiment of a rotation synchronizing control cancel determination, and FIG. 10 is a flowchart of an embodiment of rotation synchronizing control cancel determination.

Information on lever position, shift position, throttle opening, and engine rotational speed of the reference propulsion unit 5L and information on engine rotational speed, shift position, and throttle opening of the target propulsion units 5M and 5R are inputted into the control devices 18M9 and 18R9, and the control devices 18M9 and 18R9 cancel control for synchronization of the engine rotational speeds of the propulsion units at appropriate times and under appropriate conditions.

The control devices 18M9 and 18R9 preferably are constituted similarly and, in one preferred embodiment, execute the following cancel determination to cancel the control for the synchronization of the engine rotational speeds of the propulsion units.

Since a protective control such as stopping an engines is executed based on a failure signal from the failure detection device that detects failures of the vessel or the propulsion units, failure state cancel determination parts 18M93 and 18R93 determine the presence or absence of a protective control as a cancel determination condition, and the control for the synchronization of the engine rotational speed of the propulsion units is cancelled when a protective control is executed. When a sensor or actuator in systems of the propulsion units has a failure, it may make the rotation synchronizing control impossible. Thus, a protective control for systems of a plurality of propulsion units is determined as a cancel determination condition of the rotation synchronizing control and the control for the synchronization of the engine rotational speeds of the propulsion units is cancelled when a protective control is executed to achieve a stable synchronizing control.

Since a warning control such as decreasing the engine rotational speed is executed based on detection of an engine abnormality based on an abnormality signal from the engine abnormality detection device, which detects engine abnormalities of the propulsion units, warning state cancel determination parts 18M94 and 18R94 determine the presence or absence of a warning control as a cancel determination condition, and the control for the synchronization of the engine rotational speeds of the propulsion units is cancelled when a warning control is executed. Since the presence or absence of a warning control is determined as a cancel determination condition, and the control for the synchronization of the engine rotational speeds of the propulsion units is cancelled when a warning control is executed as described above, the vessel is slowed down to protect the engines when a warning of overheat or a drop in hydraulic pressure is provided. The control for the synchronization of the engine rotational speeds of the propulsion units is not cancelled when a warning control is executed to protect the engines when a warning is provided.

Cancel determination established state determination part 18M95 and 18R95 determine the duration for which the cancel determination condition has continued as a cancel execution condition, and the control for the synchronization of the engine rotational speeds of the propulsion units is cancelled when the cancel determination condition is continued for a prescribed duration. In the environment in which the propulsion units are used, the engine load conditions are changed by various factors such as waves and tides, and a cancel determination condition may be briefly satisfied, such as only for a moment. Thus, the duration for which a cancel determination condition has continued is determined as a cancel execution condition to cancel the control for the synchronization of the engine rotational speeds, and the control for the synchronization of the engine rotational speeds of the propulsion units is cancelled when the cancel determination condition is continued for a prescribed duration to achieve a stable rotation synchronizing control.

Engine rotational speed synchronization cancel determination part 18M96 and 18R96 make a cancel determination to cancel the control for the synchronization of the engine rotational speeds of the propulsion units as described below.

In step f1, it is determined whether the engine rotational speed of the reference propulsion unit is outside the range between an upper limit rotational speed and a lower limit rotational speed, and it is determined whether the engine rotational speeds of the target propulsion units are outside the range between the upper limit rotational speed and the lower limit rotational speed. For example, in one preferred embodiment the upper limit rotational speed and the lower limit rotational speed of the engine rotational speeds are 6000 rpm and 500 rpm, respectively. Different limits may be employed in other embodiments. When the engine rotational speed of one of the propulsion units is outside the range between an upper limit rotational speed and a lower limit rotational speed as described above, the control for the synchronization of the engine rotational speeds of the propulsion units is cancelled to achieve stable operation of the engines.

It is determined, based on the engine rotational speeds of target the propulsion units, whether the operating conditions of the engines do not permit the control for the synchronization of the engine rotational speeds to be executed. If the conditions do not permit, cancel of the control for the synchronization of the engine rotational speeds of the propulsion units is allowed for protection of the engines or other reasons.

Also, deviations in engine rotational speed are calculated from the engine rotational speed of the reference propulsion unit and the engine rotational speed of the target propulsion units, and it is determined whether the deviations in engine rotational speed are outside a deviation range. If they are outside the deviation range, cancel of the control for the synchronization of the engine rotational speeds of the propulsion units is allowed for protection of the engines or other reasons.

In a vessel having a plurality of propulsion units, the engine loads vary depending on the variation or installation positions of the engines of the propulsion units and the maximum rotational speeds of the engines differ from one another. When the maximum rotational speed of the reference propulsion unit is the highest, there is a possibility that the target propulsion units cannot be fully corrected. Thus, the engine rotational speed of one of the propulsion units is determined as a cancel determination condition, and the control for the synchronization of the engine rotational speeds of the propulsion units is cancelled when the engine rotational speed is equal to or higher than the upper limit rotational speed to achieve a stable synchronizing control. The value of the upper limit rotational speed as a cancel determination condition is greater than the value of the specified rotational speed as a determination condition of a synchronizing control.

In engine control at a time when the throttle openings are small, a control for achieving an idle rotational speed by correction of throttle opening and/or correction of ignition timing preferably is executed. Thus, the engine rotational speed of one of the propulsion units is determined as a synchronization control cancel determination condition and the control for the synchronization of the engine rotational speed of the propulsion units is cancelled when the engine rotational speed is equal to or lower than a lower limit rotational speed. Therefore, a control of an idle rotational speed and a rotation synchronizing control are not executed simultaneously, and stable rotation of the engines can be achieved. The value of the lower limit rotational speed as a cancel determination condition preferably is smaller than the value of the specified rotational speed as a determination condition of synchronizing control.

In step f2, based on the shift position of the control lever for the reference propulsion unit, the shift input state thereof is determined, and, based on the shift position of the control lever for the target propulsion units, the shift input state thereof is determined. If they are in an input state, it preferably is determined whether their shift positions do not coincide with each other as a cancel determination condition to cancel the control for the synchronization of the engine rotational speeds. If the shift positions do not coincide with each other, cancel of the control for the synchronization of the engine rotational speeds of the propulsion units is allowed. When the shift positions of a plurality of propulsion units are different, the engine load conditions are different, which makes rotation synchronization difficult and does not meet the intention to achieve smooth cruising. Thus, inconsistency of the shift positions preferably is determined as a cancel determination condition, and the control for the synchronization of the engine rotational speeds of the propulsion units is cancelled when the shift positions are inconsistent to achieve a control in accordance with the intention of the operator to synchronize the engine rotational speeds of a plurality of propulsion units.

In step f3, the lever position of the control lever for the reference propulsion unit and the lever position of the control lever for the target propulsion units are computed, and it is determined whether each of the lever positions is outside the range between an upper limit position and a lower limit position. If each of the lever positions is outside the range, cancel of the control for the synchronization of the engine rotational speeds of the propulsion units preferably is allowed. Also, a deviation between the lever position of the control lever for the reference propulsion unit and the lever position of the control lever for the target propulsion units is computed, and cancel of the control for the synchronization of the engine rotational speed of the propulsion units preferably is allowed when the deviation is outside a range. For example, in one embodiment the deviation in lever position at which the control for the synchronization of the engine rotational speed of the propulsion units is cancelled is greater than the value of deviation in lever position at which the control for the synchronization of the engine rotational speeds is executed. Since the lever position of the control lever for the reference propulsion unit and the lever position of the control lever for the target propulsion units, or a deviation in lever position is determined as a cancel determination condition, and it is determined whether the control levers for a plurality of propulsion units are in different angle positions from the lever positions or the deviation in lever position as described above, a rotation synchronizing control in accordance with the intention of the operator to cancel the rotation synchronization can be achieved.

When a vessel having a plurality of propulsion units is steered, especially at low speed, the control levers are considered to be operated frequently to change directions or make turns. In this case, the steering intention of the operator may be inhibited if a rotation synchronizing control can be started too easily. Also, the operator often wants to synchronize the engine rotational speeds quickly and precisely when speeds are in the cruising range. Thus, in some embodiments a cancel execution condition is set based on the lever angles of the control levers so that a rotation synchronizing control in accordance with the steering intention of the operator can be achieved.

In step f4, a reference throttle opening of the reference propulsion unit and synchronization target throttle openings of the target propulsion units are computed, and it is determined whether the reference throttle opening is outside a specified range between an upper limit and a lower limit and whether the synchronization target throttle openings are outside the specified range between an upper limit and a lower limit. If each of the throttle openings is outside the specified range, the control for the synchronization of the engine rotational speeds of the propulsion units is cancelled.

Also, deviation values between the reference throttle opening of the reference propulsion unit and the synchronization target throttle openings of the target propulsion units are computed as a cancel determination condition of the control for the synchronization of the engine rotational speeds. When the deviation values are outside a specified range, the control for the synchronization of the engine rotational speeds of the propulsion units is cancelled. For example, the deviation values between the reference throttle opening and the synchronization target throttle openings are 5° in one embodiment, and, when they are outside the specified range, the control for the synchronization of the engine rotational speeds of the propulsion units is cancelled, thus achieving a stable rotation synchronizing control which can synchronize the engine rotational speeds of a plurality of propulsion units. That is, the devices for detecting the intention of the operator to achieve rotation synchronization is the control lever angles whereas the amount of air which determines the outputs of the propulsion units is adjusted by throttle openings. Thus, the deviation values between the reference throttle opening and the synchronization target throttle openings are determined as a cancel determination condition of the control of synchronizing the engine rotational speeds, and the control of synchronizing the engine rotational speeds of the propulsion units is cancelled when the deviation values are outside a specified range. As described above, it is determined whether the deviation values between the throttle opening of the reference propulsion unit and the throttle openings of the target propulsion units are equal to or larger than a specified value as a cancel determination condition of synchronization control cancel to achieve a stable synchronization control.

In step f5, it is determined whether the synchronization target throttle openings obtained from throttle position sensor values of the target propulsion units are outside a specified range between an upper limit and a lower limit. The synchronization target throttle openings preferably are determined as a cancel determination condition of the control for the synchronization of the engine rotational speeds to allow the control for the synchronization of the engine rotational speeds of the propulsion units.

The flowchart of rotation synchronizing control cancel determination shown in FIG. 10 is next described.

In step b1, the control devices 18M9 and 18R9 of the target propulsion units 5M and 5R determine whether the reference propulsion unit 5L is in a connected state based on information about the reference propulsion unit 5L such as lever position, shift position, throttle opening, and engine rotational speed to determine whether at least two propulsion units are operating.

In step b2, if at least two propulsion units are operating, each of the control devices 18M4 and 18R4 determines whether its corresponding propulsion unit is the target propulsion unit 5M or the target propulsion unit 5R.

In step b3, the control devices 18M4 and 18R4 determine whether the shift position of the reference propulsion unit 5L is in the forward position if its corresponding propulsion unit is the target propulsion unit 5M or the target propulsion unit 5R.

In step b4, if the shift position of the reference propulsion unit 5L is in the forward position, each of the control devices 18M4 and 18R4 determines whether the shift position of its corresponding target propulsion unit 5M or 5R is in the forward position.

In step b5, each of the control devices 18M4 and 18R4 determines whether the lever position of the reference propulsion unit 5L is in the range between a lower limit specified value and an upper limit specified value if the shift position of its corresponding target propulsion unit 5M or 5R is in the forward position.

In step b6, if the lever position of the reference propulsion unit 5L is in the range between a lower limit specified value and an upper limit specified value, it is determined whether the lever position of the target propulsion units 5M and 5R is in a specified range between a lower limit specified value and an upper limit specified value.

In step b7, if the lever position of the target propulsion units 5M and 5R is in the range between a lower limit specified value and an upper limit specified value, it is determined whether the deviation value between a reference lever angle and a synchronization target lever angle is equal to or smaller than a specified value.

In step b8, if the deviation in lever position is equal to or smaller than a specified value, it is determined whether the throttle opening of the reference propulsion unit 5L is in the range between a lower limit specified value and an upper limit specified value.

In step b9, if the throttle opening of the reference propulsion unit 5L is in the range between a lower limit specified value and an upper limit specified value, it is determined whether the throttle openings of the target propulsion units 5M and 5R are in a specified range between a lower limit specified value and an upper limit specified value.

In step b10, if the throttle openings of the target propulsion units 5M and 5R are in the range between a lower limit specified value and an upper limit specified value, it is determined whether the deviations in throttle opening are equal to or smaller than a specified value.

In step b11, if the deviations in throttle opening are equal to or smaller than a specified value, it is determined whether the engine rotational speed of the reference propulsion unit 5L is in a specified range between a lower limit rotational speed and an upper limit rotational speed.

In step b12, if the engine rotational speed of the reference propulsion unit 5L is in the range between a lower limit rotational speed and an upper limit rotational speed, it is determined whether the engine rotational speeds of the target propulsion units 5M and 5R are in a specified range between a lower limit rotational speed and an upper limit rotational speed.

In step b13, if the engine rotational speeds of the target propulsion units 5M and 5R are in the specified range between a lower limit rotational speed and an upper limit rotational speed, it is determined whether the deviations in engine rotational speed are equal to or smaller than a specified value.

In step b14, if the deviations in engine rotational speed are equal to or smaller than a specified value, the presence or absence of a warning control in each propulsion unit is determined as a cancel determination condition.

In step b15, a protective control is executed based on failure signals from the failure detection devices for detecting failures of the vessel or each propulsion unit, and the presence or absence of a protective control is determined as a cancel determination condition.

In step b16, if the determination is Yes in step b1 to step b15, the process returns to start and is repeated. If the determination is No in any of the steps, it is determined whether the duration for which a determination of No has continued is longer than a prescribed time period. The duration for which the cancel determination condition has continued is determined as a cancel execution condition to cancel the control for the synchronization of the engine rotational speeds.

In step b17, if the cancel determination condition has continued for a prescribed duration, a control for the synchronization of the engine rotational speeds is cancelled.

As described above, according to the steering intention of the operator, since the operator wants to synchronize the engine rotational speeds quickly and precisely during cruising, for example, the determination condition is intended to start a synchronizing control. However, in order to facilitate stable cruising, it is preferred that the control cannot be cancelled too easily. Thus, in a preferred embodiment there is a determination condition of the control for the synchronization of the engine rotational speeds of the target propulsion units with the engine rotational speed of the reference propulsion unit, and a cancel condition of the control is provided in addition to the determination condition.

In this embodiment, since the engine operating conditions are changed by various factors such as waves and tide in the environment in which the propulsion units are used, the synchronizing control preferably is cancelled only when the deviation between the lever position of the control lever for the reference propulsion unit 5L and the lever position of the control lever for the target propulsion units 5M and 5R has been greater than a determining value for a first prescribed duration or longer or when the deviations between the engine rotational speed of the reference propulsion unit 5L and the engine rotational speed of the target propulsion units 5M and 5R have been greater than a determining value for a second prescribed duration or longer. The first prescribed duration and the second prescribed duration may be equal to or different from each other in different embodiments.

Since the control for synchronization of the engine rotational speeds of the propulsion units is cancelled when a cancel determination condition has continued for a prescribed duration in the embodiments described above, even when a cancel determination condition is satisfied for a moment, the control for synchronization of the engine rotational speeds is not necessarily cancelled. Since the control for synchronization of the engine rotational speeds of the propulsion units is cancelled only when a cancel determination condition has continued for a prescribed duration, a stable rotation synchronizing control can be realized.

Also, in steering the vessel, the control levers are thought to be operated frequently to change directions or make turns during traveling at a low speed. In this case, the steering intention of the operator may be inhibited if a rotation synchronizing control can be started too easily. However, in the cruising speed range, the operator usually wants to synchronize the engine rotational speeds quickly and precisely. Thus, a plurality of determining values for the deviation in lever position are provided and the determining values are changed depending on at least one of the engine rotational speed, engine load and lever position. It is, therefore, possible to achieve a rotation synchronizing control in accordance with the steering intention of the operator.

Also, since the engine operating conditions are changed by various factors such as waves and tide in the environment in which the propulsion units are used, a plurality of determining values for the deviation in engine rotational speed are provided, the determining values preferably are changed depending on at least one of the engine rotational speed, engine load and lever position, and the control for synchronization of the engine rotational speeds of the propulsion units is cancelled only when such determining values are met. It is, therefore, possible to achieve a stable synchronizing control.

Further, it is to be understood that various methods, sensors, and the like, may be employed. For example, the engine rotational speeds may be detected and determined from outputs from crank angle sensors or may be determined based on detection of the lever positions of the control levers or detection of the throttle openings. Also, the engine loads can be, for example, determined based on the throttle openings or the throttle openings in conjunction with the engine rotational speeds.

In some preferred embodiments, the determining value for the deviation in lever position and the determining value for the deviation in engine rotational speed are set larger as the engine rotational speed is higher, and a determining value is set for each of engine rotational speed ranges (for example, low-speed range, intermediate-speed range, and high-speed range). Also, a determining value for the engine load preferably is set for each of the low-load range, intermediate-load range and high-load range, for example. That is, in the low-rotational speed range, since the operator usually wants to make fine throttle operations, the synchronizing control is cancelled quickly to ensure quick reaction to the lever operation by the operator. In the high-rotational speed range (high-load range), since the throttles are not operated so finely as in the low-rotational speed range and since the engine rotational speeds vary significantly, the synchronizing control is not cancelled quickly, but is maintained despite momentary changes so as to improve the operability.

In a preferred embodiment, when an engine abnormality detection signal, or a failure detection signal is received, the first and second prescribed durations are set short. Thus, when a warning of overheat or a drop in hydraulic pressure is received or a sensor or actuator in the systems of the propulsion units has a failure, the control for synchronization of the engine rotational speeds of the propulsion units preferably can be cancelled when such determination conditions are satisfied for a short period of time in order to protect the engines.

In addition, in some preferred embodiments the synchronizing control is cancelled when the engine rotational speeds become equal to or higher than an upper limit set value or equal to or lower than a lower limit set value. In a vessel having a plurality of propulsion units, the engine loads vary depending on the variation or installation positions of the engines and the maximum rotational speeds of the engines may differ from one another. Thus, the upper limit rotational speed of the engine rotational speed of one of the propulsion units is determined as a cancel determination condition of the control for the synchronization of the engine rotational speeds and the control for the synchronization of the engine rotational speeds of the propulsion units preferably is cancelled when the engine rotational speeds are equal to or higher than the upper limit rotational speed.

In engine control at a time when the throttle openings are small in accordance with some preferred embodiments, a control for achieving an idle rotational speed by correction of throttle opening and correction of ignition timing is conventionally executed. Thus, the lower limit rotational speed of the engine rotational speed of one of the propulsion units is determined as a cancel determination condition of the synchronizing control and the control for the synchronization of the engine rotational speed of the propulsion units is cancelled when the engine rotational speeds are equal to or lower than the lower limit rotational speed. Therefore, since a control of an idle rotational speed and a rotation synchronizing control are prevented from overlapping with each other, a control suitable for the operating speed can be selected and stable rotation of the engines can be achieved.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A propulsion unit control system for a vessel having a plurality of propulsion units arranged side by side and electrically connected in association with two control levers that are controllable by an operator to operate a shift actuator and/or a throttle actuator of a corresponding one of the propulsion units, the control system configured to synchronize the engine rotational speed of a target one of the propulsion units with the engine rotational speed of a reference one of the propulsion units when a specified condition is satisfied, the control system comprising a first control lever corresponding to the reference propulsion unit, a second control lever corresponding to the target propulsion unit, a lever position detector adapted to detect a lever position of the first and second control levers, and an engine rotational speed detection device configured to detect an engine rotational speed of the reference propulsion unit and an engine rotational speed of the target propulsion unit, wherein the control system is configured so that, when a deviation between the first lever position and the second lever position has been equal to or greater than a lever determining value for a first prescribed duration, or when a deviation between the engine rotational speed of the reference propulsion unit and the engine rotational speed of the target propulsion unit has been equal to or greater than an engine speed determining value for a second prescribed duration, engine synchronization is cancelled.

2. The control system of claim 1, comprising a plurality of lever determining values, wherein the control system is configured to select one of the lever determining values depending on at least one of the engine rotational speed, engine load, and lever position.

3. The control system of claim 2 additionally comprising an engine abnormality detection device adapted to detect engine abnormalities in the propulsion units, and a failure detection device adapted to detect failures of the vessel or the propulsion units, wherein the control system is configured to set the first prescribed duration or the second prescribed duration short when receiving an engine abnormality detection signal or a failure detection signal.

4. The control system of claim 2, wherein the control system has an upper limit set value and a lower limit set value of the engine rotational speed, and the control system is configured to cancel engine synchronization when the engine rotational speed becomes equal to or higher than the upper limit set value or equal to or lower than the lower limit set value.

5. The control system of claim 1, comprising a plurality of engine speed determining values, wherein the control system is configured to select one of the engine speed determining values depending on at least one of the engine rotational speed, engine load, and lever position.

6. The control system of claim 5 additionally comprising an engine abnormality detection device adapted to detect engine abnormalities in the propulsion units, and a failure detection device adapted to detect failures of the vessel or the propulsion units, wherein the control system is configured to set the first prescribed duration or the second prescribed duration short when receiving an engine abnormality detection signal or a failure detection signal.

7. The control system of claim 5, wherein the control system has an upper limit set value and a lower limit set value of the engine rotational speed, and the control system is configured to cancel engine synchronization when the engine rotational speed becomes equal to or higher than the upper limit set value or equal to or lower than the lower limit set value.

8. The control system of claim 1, wherein the control system has an upper limit set value and a lower limit set value of the engine rotational speed, and the control system is configured to cancel engine synchronization when the engine rotational speed becomes equal to or higher than the upper limit set value or equal to or lower than the lower limit set value.

9. A method for controlling a plurality of propulsion units that are mounted side by side on a vessel and are electrically connected with two adjacent control levers that are controllable by an operator to operate a shift actuator and/or a throttle actuator of a corresponding one of the propulsion units, a first one of the control levers corresponding to a reference propulsion unit, a second one of the control levers corresponding to a target propulsion unit, the method comprising detecting a position of the first control lever, detecting a position of the second control lever, calculating a lever position deviation between the first and second control levers, correcting a throttle opening of the target propulsion unit to synchronize engine rotational speeds between the reference and target propulsion units, detecting an engine rotational speed of the reference propulsion unit, detecting an engine rotational speed of the target propulsion unit, calculating an engine speed deviation between the engine rotational speeds of the reference and target propulsion units, comparing the lever position deviation to a lever determining value, comparing the engine speed deviation to an engine speed determining value, and cancelling engine speed synchronization if the lever position deviation is greater than the lever determining value for greater than a first prescribed duration or if the engine speed deviation is greater than the engine speed determining value for greater than a second prescribed duration.

10. The method of claim 9 additionally comprising providing a plurality of lever determining values, and selecting one of the lever determining values depending on at least one of the engine rotational speed, engine load, and lever position.

11. The method of claim 9 additionally comprising providing a plurality of first prescribed durations and a plurality of second prescribed durations, and selecting one of the first prescribed durations and one of the second prescribed durations depending on at least one of the engine rotational speed, engine load, and lever position.

12. The method of claim 9 additionally comprising providing a plurality of engine speed determining values, and selecting one of the engine speed determining values depending on at least one of the engine rotational speed, engine load, and lever position.

13. The method of claim 9 additionally comprising providing an upper limit set value and a lower limit set value of the engine rotational speed, and cancelling engine synchronization when the engine rotational speed becomes equal to or higher than the upper limit set value or equal to or lower than the lower limit set value.

* * * * *